US011401572B2

(12) United States Patent
Yu et al.

(10) Patent No.: US 11,401,572 B2
(45) Date of Patent: *Aug. 2, 2022

(54) HIGH-HARDNESS WEAR-RESISTANT STEEL AND METHOD FOR MANUFACTURING SAME

(71) Applicant: POSCO, Pohang-si (KR)

(72) Inventors: Seng-Ho Yu, Pohang-si (KR); Mun-Young Jung, Seoul (KR); Young-Jin Jung, Pohang-si (KR)

(73) Assignee: POSCO, Pohang-si (KR)

( * ) Notice: Subject to any disclaimer, the term of this patent is extended or adjusted under 35 U.S.C. 154(b) by 210 days.

This patent is subject to a terminal disclaimer.

(21) Appl. No.: 16/471,296

(22) PCT Filed: Dec. 4, 2017

(86) PCT No.: PCT/KR2017/014087

§ 371 (c)(1),
(2) Date: Jun. 19, 2019

(87) PCT Pub. No.: WO2018/117481

PCT Pub. Date: Jun. 28, 2018

(65) Prior Publication Data

US 2019/0390293 A1 Dec. 26, 2019

(30) Foreign Application Priority Data

Dec. 22, 2016 (KR) ..... 10-2016-0177123

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/007* (2013.01);
(Continued)

(58) Field of Classification Search
CPC ..... C21D 9/46; C21D 6/004; C21D 6/005; C21D 6/007; C21D 6/008; C21D 8/0205;
(Continued)

(56) References Cited

U.S. PATENT DOCUMENTS

2010/0139820 A1* 6/2010 Kumagai ..... C21D 8/0263 148/645
2014/0003990 A1 1/2014 Kou
(Continued)

FOREIGN PATENT DOCUMENTS

CN 102234743 A 11/2011
CN 103194674 A 7/2013
(Continued)

OTHER PUBLICATIONS

Extended European Search Report dated Sep. 11, 2019 issued in European Patent Application No. 17885127.5.
(Continued)

*Primary Examiner* — Christopher S Kessler
*Assistant Examiner* — Andrew M Cheung
(74) *Attorney, Agent, or Firm* — Morgan, Lewis & Bockius LLP

(57) ABSTRACT

The present invention relates to wear-resistant steel used in construction machines, among others, and more specifically, to high-hardness wear-resistant steel having excellent wear resistance to a thickness of 40 to 130 t (mm) as well as high strength and impact toughness, and to a method for manufacturing the high-hardness wear-resistant steel.

5 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |

(52) U.S. Cl.
CPC ..... *C21D 6/008* (2013.01); *C21D 8/0205* (2013.01); *C21D 8/0247* (2013.01); *C22C 38/002* (2013.01); *C22C 38/008* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/002* (2013.01); *C21D 2211/008* (2013.01)

(58) Field of Classification Search
CPC ..... C21D 8/0247; C21D 2211/002; C21D 2211/008; C22C 38/002; C22C 38/008; C22C 38/02; C22C 38/06; C22C 38/44; C22C 38/46; C22C 38/48; C22C 38/50; C22C 38/52; C22C 38/54; C22C 38/58
See application file for complete search history.

(56) References Cited

U.S. PATENT DOCUMENTS

| | | | | |
|---|---|---|---|---|
| 2015/0211098 | A1* | 7/2015 | Li | C22C 38/14 148/547 |
| 2015/0225822 | A1* | 8/2015 | Miura | C21D 6/008 148/330 |
| 2015/0232971 | A1 | 8/2015 | Miura et al. | |
| 2016/0010191 | A1 | 1/2016 | Li et al. | |
| 2016/0060721 | A1 | 3/2016 | Nagao et al. | |
| 2016/0348208 | A1* | 12/2016 | Yuga | C22C 38/32 |

FOREIGN PATENT DOCUMENTS

| | | | | | |
|---|---|---|---|---|---|
| EP | 2592168 | A1 | | 5/2013 | |
| EP | 2592168 | A1 | * | 5/2013 | C22C 38/24 |
| EP | 2873747 | A1 | | 5/2015 | |
| JP | S61-166954 | A | | 7/1986 | |
| JP | H08-041535 | A | | 2/1996 | |
| JP | 2007092155 | A | * | 4/2007 | |
| JP | 2009-030094 | A | | 2/2009 | |
| JP | 2009-221539 | A | | 10/2009 | |
| JP | 2011-214120 | A | | 10/2011 | |
| JP | 2015-183279 | A | | 10/2015 | |
| JP | 2015183279 | A | * | 10/2015 | |
| JP | 2015-200015 | A | | 11/2015 | |
| JP | 2016-505094 | A | | 2/2016 | |
| JP | 2016-079459 | A | | 5/2016 | |
| KR | 10-1999-0042043 | A | | 6/1999 | |
| KR | 10-2003-0013806 | A | | 2/2003 | |
| KR | 10-2011-0075613 | A | | 7/2011 | |
| KR | 10-2012-0071614 | A | | 7/2012 | |
| KR | 10-2012-0071615 | A | | 7/2012 | |
| KR | 10-2013-0046967 | A | | 5/2013 | |
| KR | 10-2014-0002518 | A | | 1/2014 | |
| KR | 10-2015-0036798 | A | | 4/2015 | |
| KR | 10-2016-0078601 | A | | 7/2016 | |
| KR | 10-2018-0072500 | A | | 6/2018 | |
| WO | 2014/045552 | A1 | | 3/2014 | |
| WO | 2014/045553 | A1 | | 3/2014 | |
| WO | WO-2014045553 | A1 | * | 3/2014 | C22C 38/20 |
| WO | 2014/156078 | A1 | | 10/2014 | |

OTHER PUBLICATIONS

Japanese Office Action dated Jun. 23, 2020 issued in Japanese Patent Application No. 2019-534760.
Chinese Office Action dated Jul. 17, 2020 issued in Chinese Patent Application No. 201780079873.8.

* cited by examiner

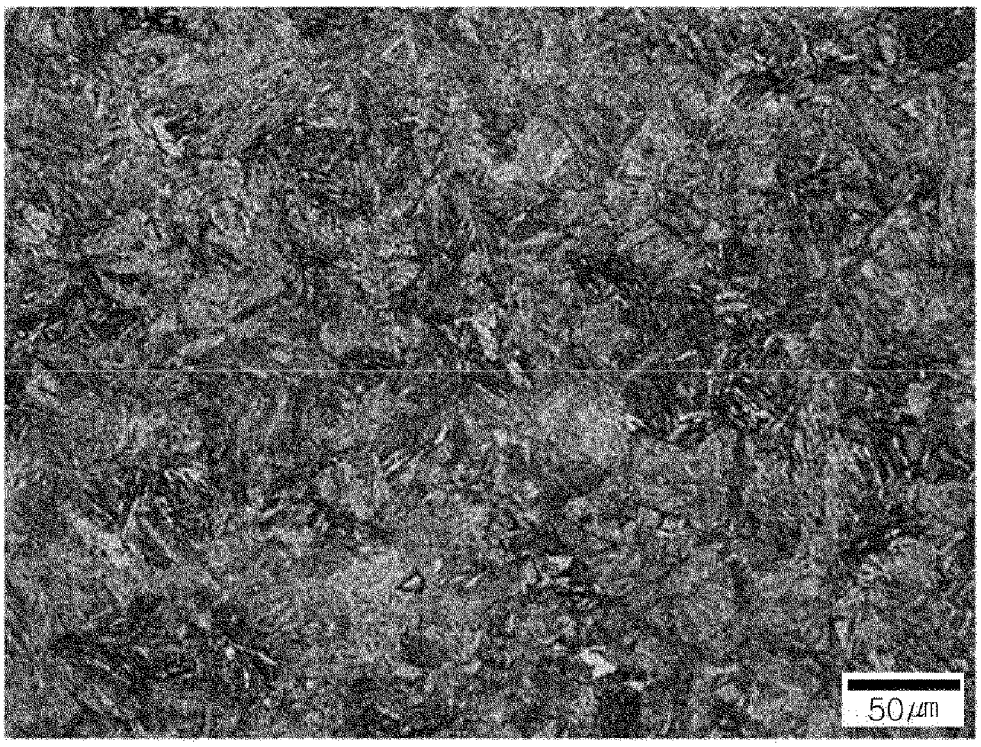
50μm

HIGH-HARDNESS WEAR-RESISTANT STEEL AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/014087, filed on Dec. 4, 2017, which in turn claims the benefit of Korean Patent Application No. 10-2016-0177123, filed Dec. 22, 2016, the entire disclosures of which applications are incorporated by reference herein.

TECHNICAL FIELD

The present disclosure relates to a wear-resistant steel used in construction machines and the like, and more particularly, to a high-hardness wear-resistant steel and a method of manufacturing the same.

BACKGROUND ART

In the case of construction machines and industrial machines used in many industrial fields, such as construction, civil engineering, the mining industry, and the cement industry, as severe wear may be caused by friction during working, the use of a material exhibiting characteristics of wear resistance is required.

In general, wear resistance and hardness of a thick steel plate are correlated with each other. Thus, in the case of a thick steel plate in which may be worn down, it is necessary to increase hardness of the thick steel plate. To ensure more stable wear resistance, it is necessary to have uniform hardness (for example, to have the same degree of hardness on a surface and in an inside of a thick steel plate) from the surface of a thick steel plate through the inside of a plate thickness (t/2 vicinity, t=thickness).

Generally, to obtain high hardness in a thick steel plate, a method of reheating to an Ac3 temperature or higher after rolling and then performing quenching is widely used.

For example, Patent Documents 1 and 2 disclose a method of increasing surface hardness by increasing a C content and adding a large amount of elements for improving hardenability, such as Cr, Mo and the like.

However, to manufacture an ultra-thick steel plate, it is necessary to add more hardenable elements to secure hardenability of a central region of a steel plate. In this case, as large amounts of C and hardenable alloy are added, there is a problem in which manufacturing costs are increased and weldability and low temperature toughness are lowered.

Therefore, there is demand for a method capable of ensuring high strength and high impact toughness as well as securing excellent wear resistance by securing high hardness in the situation in which the addition of a hardenable alloy is inevitable to secure hardenability.

(Patent Document 1) Japanese Patent Laid-Open Publication No. 1996-041535

(Patent Document 2) Japanese Patent Laid-Open Publication No. 1986-166954

DISCLOSURE Technical Problem

An aspect of the present disclosure is to provide a high-hardness wear-resistant steel having high strength and impact toughness as well as having excellent wear resistance to a thickness of 40 mm to 130 mm, and to a method of manufacturing the same.

Technical Solution

According to an aspect of the present disclosure, a high-hardness wear-resistant steel includes, by weight %, 0.10 to 0.32% of carbon (C), 0.1 to 0.7% of silicon (Si), 0.6 to 1.6% of manganese (Mn), 0.05% or less (excluding 0%) of phosphorus (P), 0.02% or less (excluding 0%) of sulfur (S), 0.07% or less (excluding 0%) of aluminum (Al), 0.1 to 1.5% of chromium (Cr), 0.01 to 2.0% of nickel (Ni), 0.01 to 0.8% of molybdenum (Mo), 50 ppm or less (excluding 0) of boron (B), and 0.04% or less (excluding 0%) of cobalt (Co), further including one or more of 0.5% or less (excluding 0%) of copper (Cu), 0.02% or less (excluding 0%) of titanium (Ti), 0.05% or less (excluding 0%) of niobium (Nb), 0.05% or less (excluding 0%) of vanadium (V), and 2 to 100 ppm of calcium (Ca), and including a remainder of iron (Fe) and other unavoidable impurities, the wear-resistant steel satisfying Relational expression 1: $t_{(V_M97)}<0.55HI$, where $t_{(V_M97)}$ is a thickness of a steel having a microstructure in which a martensite fraction is 97% or more in a central region of the steel in a thickness direction, and HI is a hardenability index determined by an alloying element and is represented by a component relationship: $HI=0.54[C]\times(0.73[Si]+1)\times(4.12[Mn]+1)\times(0.36[Cu]+1)\times(0.41[Ni]+1)\times(2.15[Cr]+1)\times(3.04[Mo]+1)\times(1.75[V]+1)\times(0.12[Co]+1)\times 33$, in which each element refers to a weight content, and a microstructure includes martensite in an area fraction of 97% or more and bainite of 3% or less.

According to another aspect of the present disclosure, a method of manufacturing a high-hardness wear-resistant steel includes preparing a steel slab satisfying the above-described alloy composition; heating the steel slab at a temperature ranging from 1050 to 1250° C.; rough-rolling the steel slab reheated, in a temperature range of 950 to 1050° C.; manufacturing a hot-rolled steel plate by finish rolling in. a temperature range of 750 to 950° C. after the rough rolling; air-cooling the hot-rolled steel plate to room temperature, and then, performing a reheating heat treatment on the hot-rolled. steel plate at a temperature ranging from 950 to 950° C. in a furnace time of 20 minutes or more; and quenching the hot-rolled steel plate to 200° C. or lower at a cooling rate of 2° C./s or more after the reheating neat treatment.

Advantageous Effects

According to an embodiment of the present disclosure, a wear-resistant steel having high hardness and high strength with respect to a thick steel material having a thickness of 40 mm to 130 mm may be provided.

In detail, a wear-resistant steel according to an embodiment of the present disclosure may a high hardness of 350 HB or more even in a center region of a plate in a thickness direction, simultaneously with securing a surface hardness of 360 to 440 HB.

DESCRIPTION OF DRAWINGS

FIG. 1 is a measurement image of a microstructure of a center region (a ½t(mm) point) of a plate in a thickness direction in Embodiment Example 3 of the present disclosure.

BEST MODE FOR INVENTION

The inventors of the present disclosure have conducted intensive studies on materials that can be suitably applied to construction machinery and the like. Particularly, to provide a steel material having high strength and high toughness in addition to high hardness to secure wear resistance, which is essentially required physical property, it is necessary to optimize the content of hardenable elements as an alloy composition and to optimize manufacturing conditions. Thus, according to an embodiment in the present disclosure, a wear-resistant steel having a microstructure favorable for securing such physical properties may be provided.

Hereinafter, embodiments of the present disclosure will be described in detail.

According to an embodiment of the present disclosure, a high-hardness wear-resistant steel may include, by weight %, 0.10 to 0.32% of carbon (C), 0.1 to 0.7% of silicon (Si), 0.6 to 1.6% of manganese (Mn), 0.05% or less (excluding 0%) of phosphorus (P), 0.02% or less (excluding 0%) of sulfur (S), 0.07% or less (excluding 0%) of aluminum (Al), 0.1 to 1.5% of chromium (Cr), 0.01 to 2.0% of nickel (Ni), 0.01 to 0.8% of molybdenum (Mo), 50 ppm or less (excluding 0) of boron (B), and 0.04% or less (excluding 0%) of cobalt (Co).

Hereinafter, the reason that the alloy composition of the high-hardness wear-resistant steel provided according to an embodiment in the present disclosure is controlled as described above will be described in detail. In this case, unless otherwise specified, the content of each component refers to weight %.

C: 0.10 to 0.32%

Carbon (C) is effective for increasing strength and hardness in steel with martensite structure, and is an element effective in improving hardenability.

To sufficiently secure the above-mentioned effect, the content of C may be 0.10% or more. However, if the content thereof exceeds 0.32%, there is a problem in which weldability and toughness are deteriorated.

Therefore, according to an embodiment in the present disclosure, the content of C may be controlled to be within a range of 0.10 to 0.32%, in more detail, 0.11 to 0.29%, and in further detail, 0.12 to 0.26%.

Si: 0.1 to 0.7%

Silicon (Si) is an element effective in improving strength by deoxidation and solid solution strengthening.

To obtain the above-mentioned effect, Si may be added in an amount of 0.1% or more. However, if the content thereof exceeds 0.7%, weldability may deteriorate.

Therefore, according to an embodiment in the present disclosure, the Si content may be controlled to be within 0.1 to 0.7%, and in more detail, within a range from 0.2 to 0.5%.

Mn: 0.6 to 1.6%

Manganese (Mn) is an element which suppresses ferrite formation and lowers the Ar3 temperature, thereby effectively increasing quenching properties and improving strength and toughness of steel.

In an embodiment in the present disclosure, the Mn content may be 0.6% or more to secure hardness of a thick steel plate. However, if the content thereof exceeds 1.6%, weldability is deteriorated.

Therefore, according to an embodiment in the present disclosure, the Mn content maybe controlled to be within a range of 0.6 to 1.6%.

P: 0.05% or less

Phosphorus (P) is an element that is inevitably contained in steel and deteriorates toughness of the steel. Therefore, the content of P may be controlled to be 0.05% or less by significantly reducing the content of P, and 0% is excluded considering the level that is inevitably contained.

S: 0.02% or less

Sulfur (S) is an element which deteriorates toughness of steel by forming MnS inclusions in steel. Therefore, the content of S may be controlled to be 0.02% or less by significantly reducing the content of S. However, 0% is excluded, considering the level that is inevitably contained.

Al: 0.07% or less (excluding 0%)

Aluminum (Al) is a deoxidizing agent for steel and is an element effective in lowering oxygen content in molten steel. If the content of Al exceeds 0.07%, there is a problem in which cleanliness of steel is deteriorated.

Therefore, according to an embodiment in the present disclosure, the Al content maybe controlled to be 0.07% or less, and 0% is excluded in consideration of an increase of load and manufacturing costs in a steelmaking process.

Cr: 0.1 to 1.5%

Chromium (Cr) increases the strength of the steel by increasing quenching properties and is an element favorable for securing hardness.

To obtain the above-mentioned effect, Cr may be added in an amount of 0.1% or more, but if the content thereof exceeds 1.5%, weldability is poor and manufacturing costs are increased.

Therefore, according to an embodiment in the present disclosure, the Cr content maybe controlled to be within a range of 0.1 to 1.5%.

Ni: 0.01 to 2.0%

Nickel (Ni) is an element effective in increasing quenching properties together with Cr, to improve toughness as well as strength of steel.

To obtain the above-mentioned effect, Ni may be added in an amount of 0.01% or more. However, if the content thereof exceeds 2.0%, toughness of the steel may be seriously deteriorated, which may cause an increase in manufacturing cost due to an expensive element.

Therefore, according to an embodiment in the present disclosure, the Ni content maybe controlled to be within a range of 0.01 to 2.0%.

Mo: 0.01 to 0.8%

Molybdenum (Mo) increases quenching properties of steel, and is an element effective in improving hardness of a thick steel plate.

To sufficiently obtain the above-mentioned effect, Mo may be added in an amount of 0.01% or more. However, since Mo is also an expensive element, and if the content thereof exceeds 0.8%, manufacturing costs are increased and weldability is deteriorated.

Therefore, according to an embodiment in the present disclosure, the Mo content maybe controlled to be within a range of 0.01 to 0.8%.

B: 50 ppm or less (excluding 0)

Boron (B) is an element effective in increasing quenching properties of steel even when added in a relatively small amount to improve strength.

However, if the content thereof is excessive, toughness and weldability of steel are deteriorated. Therefore, the content thereof may be controlled to 50 ppm or less, and 0% is excluded.

Co: 0.04% or less (excluding 0%)

Cobalt (Co) is an element favorable for securing hardness together with steel strength by increasing quenching properties of steel.

However, if the content thereof exceeds 0.04%, quenching properties of steel maybe lowered, and manufacturing costs are increased by an expensive element.

Therefore, according to an embodiment in the present disclosure, Co may be added in an amount of 0.04% or less, and 0% is excluded. In more detail, the content thereof may be within a range from 0.005 to 0.035%, and in further detail, within a range from 0.01 to 0.03%.

The wear-resistant steel according to an embodiment in the present disclosure may further include, in addition to the alloy composition described above, elements which are to secure physical properties required according to an embodiment in the present disclosure.

In detail, the wear-resistant steel may further include one or more selected from the group consisting of not more than 0.5% (excluding 0%) of copper (Cu), not more than 0.02% (excluding 0%) of titanium (Ti), not more than 0.05% (excluding 0%) of niobium (Nb), not more than 0.05% (excluding 0%) of vanadium (V), and 2 to 100 ppm of calcium (Ca).

Cu: 0.5% or less (excluding 0%)

Copper (Cu) is an element which improves quenching properties of steel and improves strength and hardness of steel by solid solution strengthening.

However, if the content of Cu exceeds 0.5%, surface defects occur, and hot workability is deteriorated. Therefore, when Cu is added, Cu may be added in an amount of 0.5% or less.

Ti: 0.02% or less (excluding 0%)

Titanium (Ti) is an element that maximizes the effect of B, an element effective in improving quenching properties of steel. In detail, Ti is bonded to nitrogen (N) to form TiN precipitates, thereby suppressing formation of BN, and thus, increasing solid solution B to significantly increase improvement of quenching properties.

However, if the content of Ti exceeds 0.02%, coarse TiN precipitates are formed and toughness of steel is inferior.

Therefore, according to an embodiment in the present disclosure, when Ti is added, Ti may be added in an amount of 0.02% or less.

Nb: 0.05% or less (excluding 0%)

Niobium (Nb) is solidified in austenite to increase hardenability of austenite, and to form carbonitride such as Nb(C, N) or the like, which is effective in increasing strength of steel and inhibiting austenite grain growth.

However, if the content of Nb exceeds 0.05%, coarse precipitates are formed, which is a starting point of brittle fracture, thereby deteriorating toughness.

Therefore, according to an embodiment in the present disclosure, when Nb is added, Nb may be added in an amount of 0.05% or less.

V: 0.05% or less (Excluding 0%)

Vanadium (V) is an element which is advantageous for suppressing growth of austenite grains, by forming VC carbides upon reheating after hot rolling, and improving quenching properties of steel, thereby securing strength and toughness.

However, the V is an expensive element, and if the content thereof exceeds 0.05%, manufacturing costs are increased.

Therefore, according to an embodiment in the present disclosure, when V is added, the content of V may be controlled to be 0.05% or less.

Ca: 2 to 100 ppm

Calcium (Ca) has an effect of suppressing formation of MnS segregated at the center region of a steel material in a thickness direction, by generating CaS due to strong binding force of Ca with S. In addition, the CaS generated by the addition of Ca has an effect of increasing corrosion resistance under a high humidity environment.

To obtain the above-mentioned effect, Ca may be added in an amount of 2 ppm or more, but if the content thereof exceeds 100 ppm, clogging of a nozzle or the like may occur during a steelmaking operation.

Therefore, according to an embodiment in the present disclosure, the content of Ca may be controlled to be within a range of 2 to 100 ppm.

Further, the high-hardness wear-resistant steel according to an embodiment in the present disclosure further includes one or more of 0.05% or less (excluding 0%) of arsenic (As), 0.05% or less (excluding 0%) of tin (Sn), and 0.05% or less (excluding 0%) of tungsten (W).

The As is effective for improving toughness of steel, and the Sn is effective for improving strength and corrosion resistance of steel. In addition, W is an element effective in improving hardness at high temperature in addition to strength improvement by increasing quenching properties.

However, if the contents of As, Sn and W each exceed 0.05%, not only manufacturing costs increase but also physical properties of the steel may be deteriorated.

Therefore, according to an embodiment in the present disclosure, in the case of additionally containing As, Sn or W, the contents thereof may be controlled to each be 0.05% or less.

The remainder in the embodiment of the present disclosure is iron (Fe). However, in an ordinary manufacturing process, impurities which are not intended may be inevitably incorporated from a raw material or a surrounding environment, and thus, cannot be excluded. These impurities they are known to any person skilled in the art of manufacturing and thus, are not specifically mentioned in this specification.

The wear-resistant steel according to an embodiment in the present disclosure, satisfying the alloy composition described above, may include a microstructure of a martensite phase as a matrix.

In more detail, the wear-resistant steel according to an embodiment in the present disclosure includes a martensite phase with an area fraction of 97% or more (including 100%), and, as the other structure thereof, may include a bainite phase. The bainite phase may be included in an area fraction of 3% or less in the wear-resistant steel, and may also be formed with 0%.

If the fraction of the martensite phase is less than 97%, there is a problem in which it is difficult to secure required strength and hardness.

According to an embodiment in the present disclosure, the martensite phase includes a tempered martensite phase. In the case in which the martensite phase includes a tempered martensite phase as described above, securing toughness of steel may be more facilitated.

In addition, in the case of the wear-resistant steel according to an embodiment in the present disclosure, the relationship of alloying elements related to the thickness and hardenability thereof may satisfy the following relational expression 1.

According to an embodiment in the present disclosure, the target hardness may be secured only by securing a martensite phase in steel to a center of the steel in a thickness direction at an area fraction of 97% or more. To this end, the following relational expression 1 should be satisfied. For example, even in the case in which the alloying elements related to the hardenability are contained, the martensite phase may not entirely be formed over the entire thickness of the steel unless the following relational expression 1 is not satisfied. Thus, the hardness may not be secured at a target level.

$$t_{(V_M97)}<0.55HI \quad \text{[Relational Expression 1]}$$

where $t_{(V_M97)}$ is a thickness of a steel having a microstructure in which a martensite fraction is 97% or more in a center region of the steel in a thickness direction, and HI is a hardenability index determined by an alloying element and is represented by a component relationship: HI=0.54[C]×(0.73[Si]+1)×(4.12[Mn]+1)×(0.36[Cu]+1)×(0.41[Ni]+1)×(2.15[Cr]+1)×(3.04 [Mo]+1)×(1.75[V]+1)×(0.12 [Co]+1)×33, in which respective elements are alloying elements related to hardenability, and refer to a weight content.

Thus, according to an embodiment in the present disclosure, the above-mentioned relational expression 1 is satisfied, and the surface hardness of 360 to 440 HB and the center hardness of 350 HB or more may be secured. For example, the hardness of the wear-resistant steel provided according to an embodiment may be 350 HB or more, over the entire thickness of the steel.

In this case, the 'surface' refers to a surface region of the steel, for example, a region of a subsurface 2 mm position below a surface of the steel in a thickness direction, and the 'center' refers to a center region of the steel in a thickness direction, for example, a region of ½t or ¼t (t refers to the thickness (mm) of steel), but embodiments thereof are not limited thereto.

Hereinafter, a method of manufacturing a high-hardness wear-resistant steel according to another embodiment in the present disclosure will be described in detail.

Briefly, a steel slab satisfying the alloy composition as described above may be prepared, and then, the steel slab may be subjected to a process of [reheating—rough rolling—finish rolling—air cooling—reheating heat treatment—quenching], thereby manufacturing a high-hardness wear-resistant steel. Hereinafter, respective process conditions will be described in detail.

First, a steel slab satisfying the alloy composition proposed in an embodiment in the present disclosure may be prepared, and then heated at a temperature ranging from 1050 to 1250° C.

If the temperature during the heating is lower than 1050° C., re-solid solution of Nb or the like is insufficient, while if the temperature exceeds 1250° C., austenite grains are coarsened, and thus an ununiform structure may be formed.

Therefore, according to an embodiment in the present disclosure, the heating may be performed in a temperature range of 1050 to 1250° C. when heating the steel slab.

The heated steel slab may be subjected to rough rolling and finish rolling to produce a hot-rolled steel plate.

First of all, the heated steel slab is rough-rolled in a temperature range of 950 to 1050° C. to manufacture a bar, and then the bar maybe finishing hot-rolled in a temperature range of 750 to 950° C.

If the temperature during rough-rolling is less than 950° C., the rolling load is increased and relatively weakly pressed, so that the deformation is not sufficiently applied to the center of the slab in a thickness direction, and thus, defects such as pores may not be removed. On the other hand, if the temperature exceeds 1050 ° C., the grains grow after the recrystallization occurs at the same time as rolling, and thus, initial austenite grains may become significantly coarse.

If the finishing temperature is less than 750° C., there is a possibility that ferrite may be formed in the microstructure due to two-phase region rolling. On the other hand, if the temperature exceeds 950° C., a rolling roll load becomes excessive and rolling properties may be inferior.

The hot-rolled steel plate manufactured according to the above-mentioned method may be air-cooled to room temperature and then subjected to a reheating heat treatment at a temperature ranging from 850 to 950° C. in a furnace time of 20 minutes or more.

The reheating heat treatment is for reverse transforming the hot-rolled steel plate composed of ferrite and pearlite into an austenite single-phase. If the temperature is lower than 850° C. during the reheating heat treatment, austenitization is not sufficiently performed and coarse soft ferrite is mixed, and thus, there is a problem in which hardness of a final product may be lowered. On the other hand, if the temperature exceeds 950 ° C., the austenite grains become coarse and the effect of increasing quenching properties is increased, but the low-temperature toughness of steel is inferior.

If a furnace time is less than 20 minutes in reheating in the above-mentioned temperature range, austenitization does not sufficiently take place, such that phase transformation due to subsequent rapid cooling, that is, martensite structure may not be sufficiently obtained.

After completion of the reheating heat treatment, the rot-rolled steel plate may be subjected to quenching to 200° C. or less, at a cooling rate of 2° C./s or more, based on the center region of the plate thickness (for example, ½t point (t refers to a thickness (mm)). In this case, the cooling may be water-cooling.

If the cooling rate after the reheating heat treatment is less than 2° C./s or a cooling stop temperature exceeds 200° C., a ferrite phase maybe formed or an excessive bainite phase may be formed during quenching.

In an embodiment of the present disclosure, an upper limit of the cooling rate is not particularly limited, and may be suitably set in consideration of facility limits.

As described above, the hot-rolled steel plate that has been cooled satisfies the above-described relational expression 1, and a wear-resistant steel having excellent strength and hardness may be provided as the microstructure is formed as intended in the present disclosure.

On the other hand, the hot-rolled steel plate after completion of the reheating heat treatment and quenching process may be an thick steel plate having a thickness of 40 to 130 mm, and a tempering process may be further performed on the thick steel plate.

According to an embodiment in the present disclosure, the tempering process maybe performed for a steel containing carbon in the steel in an amount of more than 0.16%, in more detail, 0.18% or more, to secure the center region hardness to the target level as well as the surface hardness of the steel. However, even in a case in which the carbon content in steel is 0.16% or less, the tempering process may be carried out without difficulty.

In detail, in the tempering process, the reheating heat treated and quenched hot-rolled steel plate may be heated to a temperature ranging from 300 to 600° C. and may then be heat-treated within 60 minutes.

If the temperature is lower than 300° C. in the tempering process, brittleness of tempered martensite may occur and the strength and toughness of the steel maybe lowered. On the other hand, if the temperature exceeds 600° C., the strength of steel may drop sharply due to recrystallization.

If the period is more than 60 minutes in the tempering process, the high dislocation density in the martensite structure, formed after quenching, is lowered, resulting in a drastic decrease in hardness.

The hot-rolled steel plate according to an embodiment in the present disclosure produced according to the above-described manufacturing conditions has a microstructure, a martensite phase (including tempered martensite) as a main phase, and has a high degree of hardness over the entire thickness.

Hereinafter, embodiments in the present disclosure will be described in more detail. It should be noted, however, that the following embodiments are intended to illustrate the invention in more detail and not to limit the scope of the invention. The scope of the present disclosure is determined by the matters set forth in the claims and the matters reasonably inferred therefrom.

MODE FOR INVENTION

Embodiment

After steel slabs having alloy compositions shown in Tables 1 and 2 were prepared, the steel slabs were heated at a temperature ranging from 1050 to 1250° C. and then subjected to rough rolling in a temperature range of 950 to 1050° C., to produce a bar. Then, each of the bars was subjected to finish rolling at the temperature shown in Table 3 to manufacture a hot-rolled steel plate, and the manufactured hot-rolled steel plate was then cooled to room temperature. Subsequently, the hot-rolled steel plate was subjected to a reheating heat treatment and then water cooling (quenching). At this time, conditions for the reheating heat treatment and water cooling are shown in Table 3 below.

Some of the hot-rolled steel plates manufactured as described above were further subjected to a tempering heat treatment.

Then, the microstructure and mechanical properties of each hot-rolled steel plate were measured, and the results are shown in Table 4 below.

In the microstructure, specimen was prepared by cutting to a required size to produce a polished surface, followed by etching using a Nital solution. Then, a 2 mm position from a surface layer of the microstructure in a thickness direction and a ½t(mm) position in the center of the microstructure in the thickness direction were both observed, using an optical microscope and a scanning electron microscope.

The hardness and toughness were measured using a Brinell hardness tester (load 3000 kgf, a tungsten indenter having a diameter of 10 mm) and a Charpy impact tester. In this case, the surface hardness is an average value of three measurements after milling 2 mm of a plate surface. The section hardness is an average value of three measurements at the center, for example, a ½t position, of the plate in a thickness direction, after cutting the specimen in the thickness direction of the plate. In addition, the Charpy impact test results were obtained by taking an average of three measurements at −40° C. after taking the specimen from a ¼t position.

TABLE 1

| Steel | Alloy Composition (Weight %) | | | | | | | | | | |
|---|---|---|---|---|---|---|---|---|---|---|---|
| Grade | C | Si | Mn | P | S | Al | Cr | Ni | Mo | B | Co |
| A | 0.127 | 0.35 | 1.67 | 0.012 | 0.0030 | 0.031 | 0.15 | 0 | 0 | 0.0015 | 0 |
| B | 0.254 | 0.38 | 0.85 | 0.008 | 0.0012 | 0.035 | 0 | 0.21 | 0.55 | 0.0002 | 0 |
| C | 0.292 | 0.21 | 0.77 | 0.011 | 0.0009 | 0.023 | 0.84 | 0.35 | 0.21 | 0.0012 | 0 |
| D | 0.245 | 0.25 | 0.85 | 0.007 | 0.0020 | 0.046 | 0.78 | 0.47 | 0.36 | 0.0014 | 0.01 |
| E | 0.151 | 0.30 | 1.38 | 0.008 | 0.0008 | 0.024 | 0.58 | 0.59 | 0.65 | 0.0022 | 0.01 |
| F | 0.163 | 0.31 | 1.37 | 0.007 | 0.0020 | 0.025 | 0.31 | 1.64 | 0.38 | 0.0020 | 0.01 |
| G | 0.125 | 0.31 | 1.51 | 0.007 | 0.0013 | 0.026 | 0.45 | 0.90 | 0.49 | 0.0018 | 0.01 |

TABLE 2

| Steel | Alloy Composition (Weight %) | | | | | | | | HI |
|---|---|---|---|---|---|---|---|---|---|
| Grade | Cu | Ti | Nb | V | Ca | As | Sn | W | Value |
| A | 0.05 | 0.014 | 0.041 | 0.01 | 0.0002 | 0 | 0 | 0 | 30.7 |
| B | 0.15 | 0.017 | 0.025 | 0 | 0.0004 | 0 | 0 | 0 | 79.6 |
| C | 0.06 | 0.006 | 0.007 | 0 | 0.0010 | 0 | 0 | 0 | 134.5 |
| D | 0.01 | 0.003 | 0.015 | 0.01 | 0.0005 | 0.003 | 0.004 | 0.01 | 158.9 |
| E | 0.01 | 0.015 | 0.013 | 0.05 | 0.0012 | 0.002 | 0.004 | 0 | 199.0 |
| F | 0.04 | 0.014 | 0.004 | 0.03 | 0.0003 | 0.003 | 0.003 | 0 | 152.0 |
| G | 0.02 | 0.016 | 0.014 | 0.05 | 0.0009 | 0.003 | 0.004 | 0.01 | 144.1 |

TABLE 3

| | Manufacturing Conditions | | | | | | | | |
|---|---|---|---|---|---|---|---|---|---|
| | Finish | Reheating Heat Treatment | | Quenching | | Tempering | | | |
| Steel Grade | Rolling Temperature (° C.) | Temperature (° C.) | Duration time (min) | Cooling Rate (° C./s) | Stop Temperature (° C.) | Temperature (° C.) | Duration Time (min) | Thickness (mm) | Classification |
| A | 1020 | 912 | 94 | 12.5 | 130 | — | — | 50 | Comparative Example 1 |
| | 961 | 860 | 105 | 4.6 | 75 | 350 | 50 | 60 | Comparative Example 2 |
| | 934 | 935 | 114 | 1.3 | 43 | — | — | 80 | Comparative Example 3 |
| B | 945 | 906 | 120 | 2.5 | 35 | — | — | 70 | Comparative Example 4 |
| | 943 | 868 | 105 | 3.1 | 26 | 380 | 25 | 70 | Comparative Example 5 |
| | 948 | 899 | 132 | 1.1 | 129 | — | — | 80 | Comparative Example 6 |
| C | 915 | 900 | 92 | 15.0 | 36 | — | — | 50 | Comparative Example 7 |
| | 913 | 902 | 92 | 16.7 | 38 | 400 | 82 | 50 | Comparative Example 8 |
| | 936 | 901 | 113 | 7.4 | 241 | — | — | 70 | Comparative Example 9 |
| D | 946 | 910 | 131 | 4.0 | 27 | 402 | 34 | 80 | Embodiment Example 1 |
| | 940 | 908 | 134 | 4.4 | 32 | — | — | 80 | Comparative Example 10 |
| | 944 | 879 | 130 | 3.1 | 255 | — | — | 80 | Comparative Example 11 |
| E | 920 | 899 | 95 | 19.0 | 239 | — | — | 60 | Comparative Example 12 |
| | 935 | 901 | 120 | 5.8 | 27 | — | — | 80 | Embodiment Example 2 |
| | 944 | 913 | 141 | 2.1 | 22 | — | — | 100 | Embodiment Example 3 |
| F | 911 | 934 | 108 | 17.8 | 131 | — | — | 60 | Embodiment Example 4 |
| | 936 | 916 | 140 | 3.4 | 30 | 354 | 23 | 70 | Embodiment Example 5 |

TABLE 3-continued

| Steel Grade | Manufacturing Conditions: Finish: Rolling Temperature (° C.) | Reheating Heat Treatment: Temperature (° C.) | Reheating Heat Treatment: Duration time (min) | Quenching: Cooling Rate (° C./s) | Quenching: Stop Temperature (° C.) | Tempering: Temperature (° C.) | Tempering: Duration Time (min) | Thickness (mm) | Classification |
|---|---|---|---|---|---|---|---|---|---|
| | 948 | 940 | 184 | 2.5 | 19 | — | — | 80 | Embodiment Example 6 |
| G | 926 | 866 | 93 | 15.5 | 123 | — | — | 50 | Embodiment Example 7 |
| | 944 | 891 | 121 | 4.4 | 17 | — | — | 60 | Embodiment Example 8 |
| | 947 | 917 | 138 | 3.1 | 18 | — | — | 70 | Embodiment Example 9 |

TABLE 4

| Classification | Microstructure (Area Fraction %): Martensite: Surface | Martensite: Center | Bainite: Surface | Bainite: Center | Whether to satisfy Relational Expression 1 | Mechanical Properties: Surface Hardness (HB) | Center Hardness (HB) | Impact Toughness (J) |
|---|---|---|---|---|---|---|---|---|
| Comparative Example 1 | 100 | 90 | 0 | 10 | — | 405 | 338 | 78 |
| Comparative Example 2 | 98 | 82 | 2 | 18 | — | 354 | 296 | 125 |
| Comparative Example 3 | 100 | 64 | 0 | 36 | — | 408 | 301 | 116 |
| Comparative Example 4 | 100 | 96 | 0 | 4 | — | 516 | 463 | 29 |
| Comparative Example 5 | 98 | 94 | 2 | 6 | — | 462 | 414 | 40 |
| Comparative Example 6 | 99 | 71 | 1 | 29 | — | 495 | 332 | 31 |
| Comparative Example 7 | 100 | 100 | 0 | 0 | ○ | 549 | 513 | 23 |
| Comparative Example 8 | 99 | 96 | 1 | 4 | — | 422 | 345 | 35 |
| Comparative Example 9 | 99 | 97 | 1 | 3 | ○ | 461 | 390 | 41 |

TABLE 4-continued

| Classification | Microstructure (Area Fraction %) Martensite Surface | Martensite Center | Bainite Surface | Bainite Center | Whether to satisfy Relational Expression 1 | Mechanical Properties Surface Hardness (HB) | Center Hardness (HB) | Impact Toughness (J) |
|---|---|---|---|---|---|---|---|---|
| Embodiment Example 1 | 99 | 98 | 1 | 2 | ○ | 398 | 364 | 38 |
| Comparative Example 10 | 100 | 100 | 0 | 0 | ○ | 504 | 466 | 28 |
| Comparative Example 11 | 100 | 98 | 0 | 2 | ○ | 477 | 387 | 46 |
| Comparative Example 12 | 100 | 95 | 0 | 5 | — | 416 | 336 | 51 |
| Embodiment Example 2 | 100 | 99 | 0 | 1 | ○ | 406 | 355 | 57 |
| Embodiment Example 3 | 100 | 98 | 0 | 2 | ○ | 409 | 364 | 78 |
| Embodiment Example 4 | 100 | 99 | 0 | 1 | ○ | 437 | 391 | 56 |
| Embodiment Example 5 | 99 | 98 | 1 | 2 | ○ | 400 | 369 | 62 |
| Embodiment Example 6 | 100 | 98 | 0 | 2 | ○ | 432 | 363 | 58 |
| Embodiment Example 7 | 99 | 98 | 1 | 2 | ○ | 387 | 355 | 65 |
| Embodiment Example 8 | 100 | 100 | 0 | 0 | ○ | 407 | 360 | 61 |
| Embodiment Example 9 | 100 | 99 | 0 | 1 | ○ | 404 | 369 | 59 |

As shown in Tables 1 to 4, Embodiment Examples 1 to 9, which satisfied all of the steel alloy composition, the relational expression 1 and the manufacturing conditions, had a martensite phase of 97% or more at the center region of the steel in the thickness direction. In addition to high strength and toughness, surface and center hardness values were formed at the target levels.

In Comparative Examples 1 to 3 using Steel A, the surface hardness satisfied the level of the present disclosure, but the martensite phase was insufficient at the center region, and the center hardness of 350 HB or more could not be secured.

The surface hardness of Comparative Example 4, using Steel B containing carbon of a predetermined amount or more, was excessively high, exceeding 440 HB. In Comparative Example 5, the surface hardness was relatively high even when the tempering was performed to lower the surface hardness. In Comparative Example 6 in which cooling was performed at a very slow cooling rate during quenching after the reheating heat treatment, a large amount of bainite phase was generated in the center region of the steel and thus, the center hardness of 350 HB or more could not be satisfied.

In Comparative Example 7 using Steel C containing a predetermined amount or more of carbon, the surface hardness was very high as the degree of about 550 HB due to rapid-cooling during quenching after reheating heat treatment. In Comparative Example 8, the tempering was performed to lower the surface hardness in Comparative Example 8, but the center hardness was lowered together, and thus, the center hardness of 350 HB or more could not be satisfied. Also in the case of Comparative Example 9, the surface hardness exceeded 440 HB by not performing tempering.

In the case of Comparative Examples 10 and 11, a steel containing a predetermined amount or more of carbon was used, but the surface hardness exceeded 440 HB due to no tempering process.

In Comparative Example 12, the martensitic phase fraction was not sufficiently formed at the center region of the steel due to the cooling stop temperature exceeding 200° C. during the quenching after the reheating heat treatment, resulting in a decrease in the center hardness.

FIG. 1 shows the result of observing a center region of microstructure of Embodiment Example 3, and it can be visually confirmed that a martensite phase is formed.

The invention claimed is:

1. A steel comprising:

by weight %, 0.10 to 0.32% of carbon (C), 0.1 to 0.7% of silicon (Si), 0.6 to 1.6% of manganese (Mn), 0.05% or less, excluding 0%, of phosphorus (P), 0.02% or less, excluding 0%, of sulfur(S), 0.07% or less, excluding 0%, of aluminum (Al), 0.1 to 1.5% of chromium (Cr), 0.01 to 2.0% of nickel (Ni), 0.01 to 0.8% of molybdenum (Mo), 50 ppm or less, excluding 0, of boron (B), 0.01 to 0.04% of cobalt (Co), 0.05% or less, excluding 0%, of tin (Sn), 0.05% or less, excluding 0%, of tungsten (W), and optionally 0.05% or less, excluding 0%, of arsenic(As), the wear-resistant steel further comprising two or more of 0.5% or less, excluding 0%, of copper (Cu), 0.02% or less, excluding 0%, of titanium (Ti), 0.05% or less, excluding 0%, of niobium (Nb), 0.05% or less, excluding 0%, of vanadium (V), and 2 to 100 ppm of calcium (Ca), and comprising a remainder of iron (Fe) and other unavoidable impurities, and satisfying Relational expression 1: $t_{(V_M97)}<0.55HI$, where $t_{(V_M97)}$ is a thickness, mm, of the steel having a microstructure in which a martensite fraction is 97% or more in a center region of the steel in a thickness direction, and HI is a hardenability index determined by an alloying element and is represented by a component relationship: $HI=0.54[C]\times(0.73[Si]+1)\times(4.12[Mn]+1)\times(0.36[Cu]+1)\times(0.41[Ni]+1)\times(2.15[Cr]+1)\times(3.04[Mo]+1)\times(1.75[V]+1)\times(0.12[Co]+1)\times33$, in which each element refers to a weight content, wherein the center region of the steel in a thickness direction is a region of ½t or ¼t, where t is the thickness, mm, of steel, wherein a microstructure includes martensite having an area fraction of 97% or more and bainite of 3% or less, wherein the steel has a thickness of 40 mm to 130 mm.

2. The steel of claim 1, wherein the wear-resistant steel satisfies a surface hardness of 360 to 440 HB and has a center region hardness of 350 HB or more.

3. A method of manufacturing a steel according to claim 1 comprising: preparing a steel slab including, by weight %, 0.10 to 0.32% of carbon (C), 0.1 to 0.7% of silicon (Si), 0.6 to 1.6% of manganese (Mn), 0.05% or less, excluding 0%, of phosphorus (P), 0.02% or less, excluding 0%, of sulfur (S), 0.07% or less, excluding 0%, of aluminum (Al), 0.1 to 1.5% of chromium (Cr), 0.01 to 2.0% of nickel (Ni), 0.01 to 0.8 of molybdenum (Mo), 50 ppm or less, excluding 0, of boron (B), the steel slab further comprising two or more of 0.5% or less, excluding 0%, of copper (Cu), 0.02% or less, excluding 0%, of titanium (Ti), 0.05% or less, excluding 0%, of niobium (Nb), 0.05% or less, excluding 0%, of vanadium (V), and 2 to 100 ppm of calcium (Ca), and comprising a remainder of iron (Fe) and other unavoidable impurities;

heating the steel slab at a temperature ranging from 1050 to 1250° C.;

rough-rolling the steel slab, in a temperature range of 950 to 1050° C.;

manufacturing a hot-rolled steel plate by finish-rolling the steel slab in a temperature range of 750-1050° C. after the rough rolling;

air-cooling the hot-rolled steel plate to room temperature, and then, performing a reheating heat treatment on the hot-rolled steel plate at a temperature ranging from 850 to 950° C. in a furnace for a duration of 20 minutes or longer; and quenching the hot-rolled steel plate to 200° C. or lower at a cooling rate of 2° C./s or more after the reheating heat treatment.

4. The method of manufacturing a steel of claim 3, further comprising heating to a temperature ranging from 300 to 600° C. after the cooling to 200° C. or lower, and then, performing a heat treatment within 60 minutes.

5. The method of manufacturing a steel of claim 3, wherein the steel slab further comprises 0.05% or less, excluding 0%, of arsenic (As).

* * * * *